US008540480B2

(12) United States Patent
Rawlinson

(10) Patent No.: US 8,540,480 B2
(45) Date of Patent: Sep. 24, 2013

(54) AEROFOIL HAVING A PLURALITY COOLING AIR FLOWS

(75) Inventor: Anthony J. Rawlinson, Derby (GB)

(73) Assignee: Rolls-Royce PLC, London (GB)

( * ) Notice: Subject to any disclaimer, the term of this patent is extended or adjusted under 35 U.S.C. 154(b) by 773 days.

(21) Appl. No.: 12/591,307

(22) Filed: Nov. 16, 2009

(65) Prior Publication Data

US 2010/0172762 A1 Jul. 8, 2010

(30) Foreign Application Priority Data

Jan. 7, 2009 (GB) ..... 0900087.8

(51) Int. Cl.
*F01D 5/18* (2006.01)
*F04D 29/58* (2006.01)

(52) U.S. Cl.
USPC ..... 415/115; 416/97 R; 416/95

(58) Field of Classification Search
USPC ..... 415/115; 416/95, 96 R, 97 R
See application file for complete search history.

(56) References Cited

U.S. PATENT DOCUMENTS 3,672,787 A * 6/1972 Thortenson ..... 416/97 R
4,992,025 A * 2/1991 Stroud et al. ..... 416/97 R
5,342,172 A 8/1994 Coudray et al.
5,356,265 A * 10/1994 Kercher ..... 416/97 R
5,374,162 A 12/1994 Green
6,164,913 A 12/2000 Reddy
6,328,531 B1 12/2001 Bariaud et al.
7,704,047 B2 * 4/2010 Liang et al. ..... 416/97 R
8,066,482 B2 * 11/2011 Strohl et al. ..... 416/95
2005/0281675 A1 12/2005 Liang
2010/0115967 A1 * 5/2010 Maltson ..... 60/806

FOREIGN PATENT DOCUMENTS

EP 1 645 721 A2 4/2006
EP 1 645722 A2 4/2006
GB 2 184 492 A 6/1987

OTHER PUBLICATIONS

British Search Report issued in British Application No. 0900087.8 on Apr. 20, 2009.

* cited by examiner

*Primary Examiner* — Nathaniel Wiehe
*Assistant Examiner* — Aaron Jagoda
(74) *Attorney, Agent, or Firm* — Oliff & Berridge, PLC

(57) ABSTRACT

An aerofoil (20) for a gas turbine engine (10) is hollow to define an interior volume (24) through which cooling air flows. Passages (26) interconnect the interior volume (24) with the exterior of the aerofoil (20). Each passage (26) is provided with an inlet (32) within the interior volume (24) which is elongated along an axis (36) parallel with the direction of cooling air flow through the interior volume (24). The arrangement reduces any tendency for the passages (24) to block though the build up of dirt particles.

14 Claims, 3 Drawing Sheets

AEROFOIL HAVING A PLURALITY COOLING AIR FLOWS

The present invention relates to an aerofoil, particularly but not exclusively an aerofoil for a gas turbine engine.

Conventionally, turbine blades and nozzle guide vanes within gas turbine engines include aerofoils which are hollow. Each aerofoil defines an interior and passages through the aerofoil walls from the interior to the exterior. Cooling air flows radially outwardly along the interior and along the passages, so as to form an external cooling film over the external surfaces of the aerofoil, protecting the material of the aerofoil from hot combustion gases. The design of the cooling passages must satisfy a number of requirements. The flow rate along the passages must be sufficient to prevent back flow of combustion gases while providing a cooling film rather than a jet. The flow rate must be minimised to minimise the amount of air bled from the compressor. The flow rate must be sufficient to ensure adequate cooling of the aerofoil surfaces, and thus provide a satisfactory working life of the engine components.

One problem encountered is blocking of the cooling passages by a build up of internal and external dirt. Such blockages alter the cooling air flows, changing the relatively delicate balance of design parameters outlined above and thus affecting either the efficiency of the engine or the working life of the components, or both. The fact that blockages will occur has to be taken into account by the designer, who thus has to provide an initial excess of holes and/or larger holes with consequently increased manufacturing costs, increased complexity and reduced operating efficiency. The provision of larger holes reduces cooling efficiency.

According to a first aspect of the present invention, there is provided an aerofoil for a gas turbine engine, the aerofoil including at least one wall defining an interior along which in use cooling air flow's in a first direction, the at least one wall defining a passage extending from an interior surface of the one wall to an exterior surface of the at least one wall to permit in use a cooling air flow in a second direction therealong, the passage including an inlet area defined by the interior surface, the inlet area having a shape which is elongated along one axis, the elongate axis of the inlet area extending along or being substantially parallel with the first cooling air flow direction an external fluid flowing across the exterior surface of the at least one wall in a third direction. The cooling air on exiting the passage flowing in the third direction. The passage including an outlet area, which may be defined by the exterior surface, and which may have a shape which is elongated along one axis.

Possibly, the elongate axis of the inlet area lies on a first plane, and the first and second directions lie on the same plane.

Possibly, the elongate axis of the outlet area extends along or is substantially parallel to the third direction. Possibly the third direction is substantially at an angle to the first direction when viewed along the length of the passage, which angle may be substantially 90°. Possibly, the elongate axis of the outlet area lies on a second plane, and the second and third directions lie on the same plane.

Possibly, the second plane is orientated at an angle to the first plane, and may be orientated at substantially 90° to the first plane.

Possibly, the aerofoil has a length, and the interior extends along the length. Possibly, the passage extends laterally through the wall. Possibly, the first direction is along the length. Possibly, the second direction is at an angle to the first direction, and may be substantially at 90° to the first direction.

The inlet area may be elliptical or oval in shape. The outlet area may be elliptical or oval in shape.

The aerofoil may define a plurality of passages, which may be regularly spaced, and may be arranged in rows, which may extend along the length of the aerofoil.

The aerofoil may be formed by soluble core casting, and may be formed using a laser. The aerofoil may form part of a turbine or a nozzle guide vane for a gas turbine engine.

According to a second aspect of the present invention, there is provided a gas turbine engine, the engine including an aerofoil, the aerofoil being as described in any of the preceding statements.

According to a third aspect of the present invention, there is provided a method of cooling a gas turbine engine, the method including providing an aerofoil, the aerofoil being as described in any of the said preceding paragraphs.

An embodiment of present invention will now be described, by way of example only, and with reference to the accompanying drawings, in which:—

Figure 1:
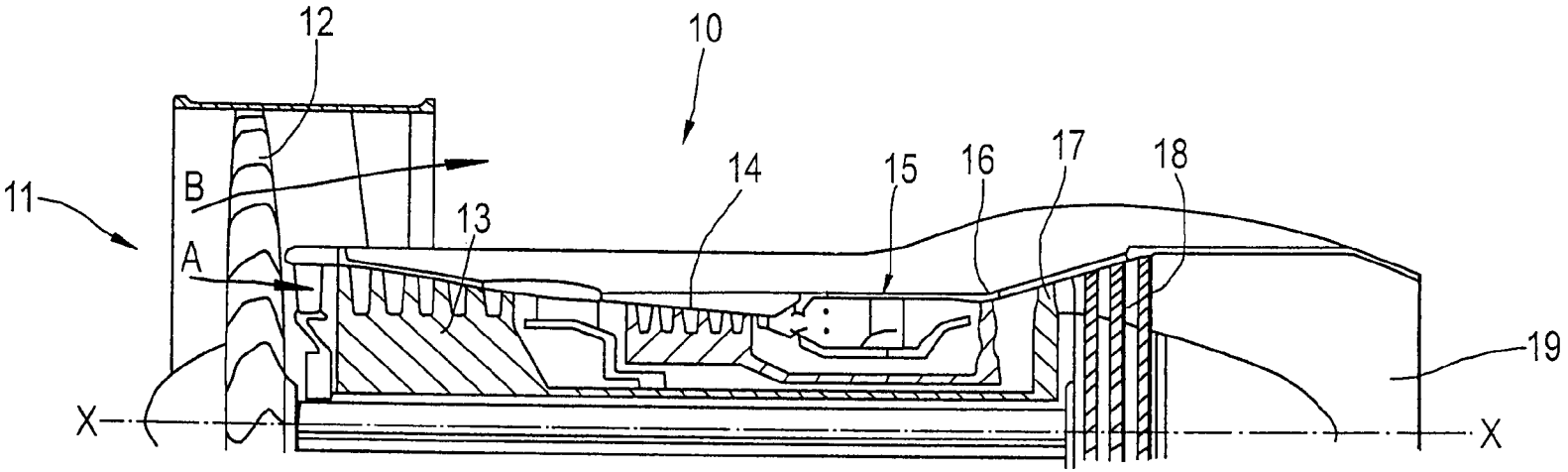
FIG. 1 is a side sectional view of part of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow, indicated by arrow A into the intermediate pressure compressor 13 and a second air flow indicated by arrow B which provides propulsive thrust. The intermediate pressure compressor compresses the air flow A directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
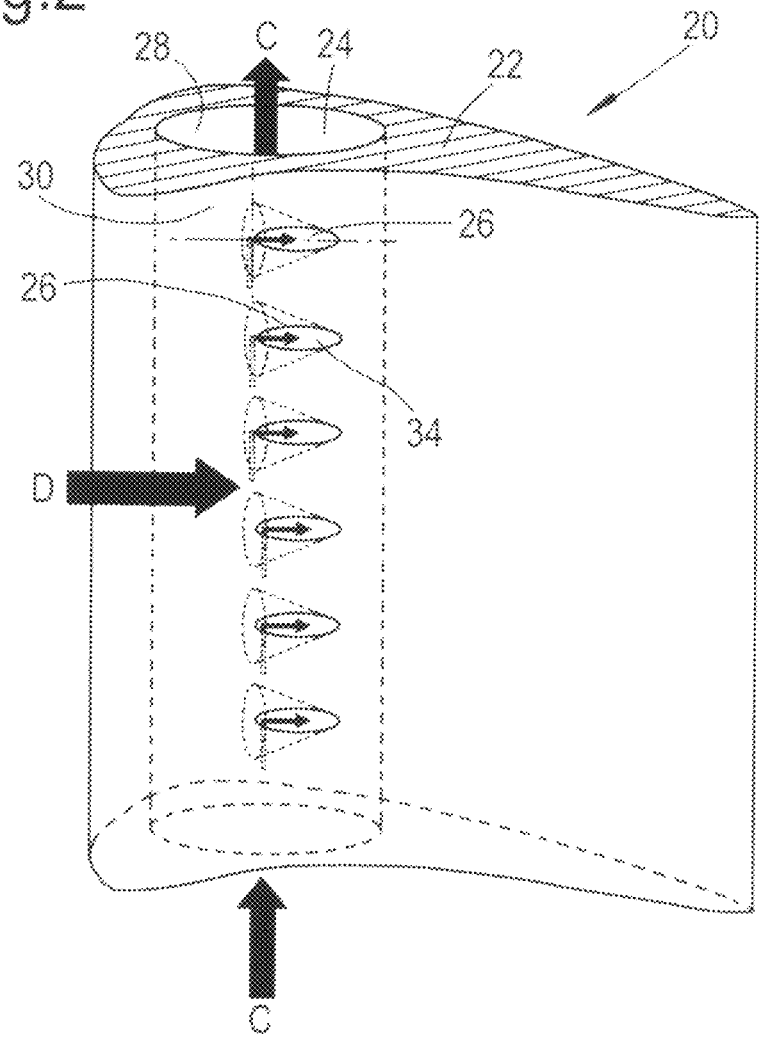
FIG. 2 is a perspective view of part of an aerofoil.

FIG. 2 shows a section of an aerofoil 20. The aerofoil 20 could form part of a turbine blade or nozzle guide vane of one of the high, intermediate or low pressure turbines 16, 17, 18. The aerofoil 20 includes walls 22 which define an interior 24 and a plurality of through passages 26 which extend from an interior wall surface 28 to an exterior wall surface 30. As shown in FIG. 2, the passages 26 are arranged in a row at a regular spacing extending along the length of the aerofoil 20. The interior 24 extends along the length of the aerofoil 20.

Each of the passages 26 includes an inlet area 32 defined by the interior wall surface 28 and an outlet area 34 defined by the exterior wall surface 30.

Figure 5:
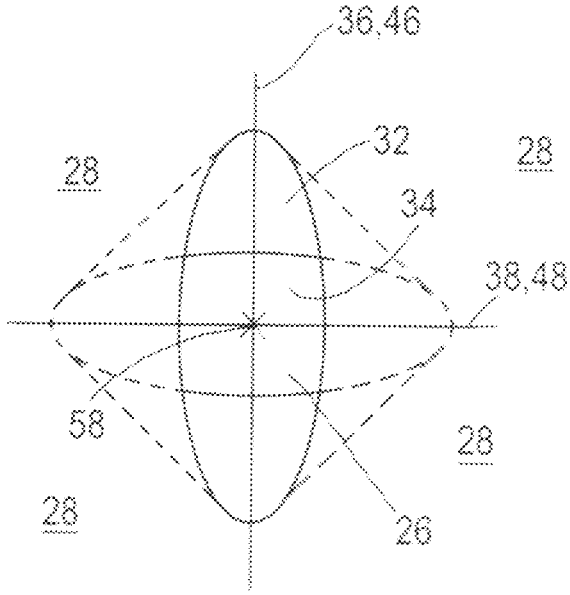
FIG. 5 is a side view of the wall of the aerofoil, along arrow G as indicated in FIG. 3.
Figure 3:
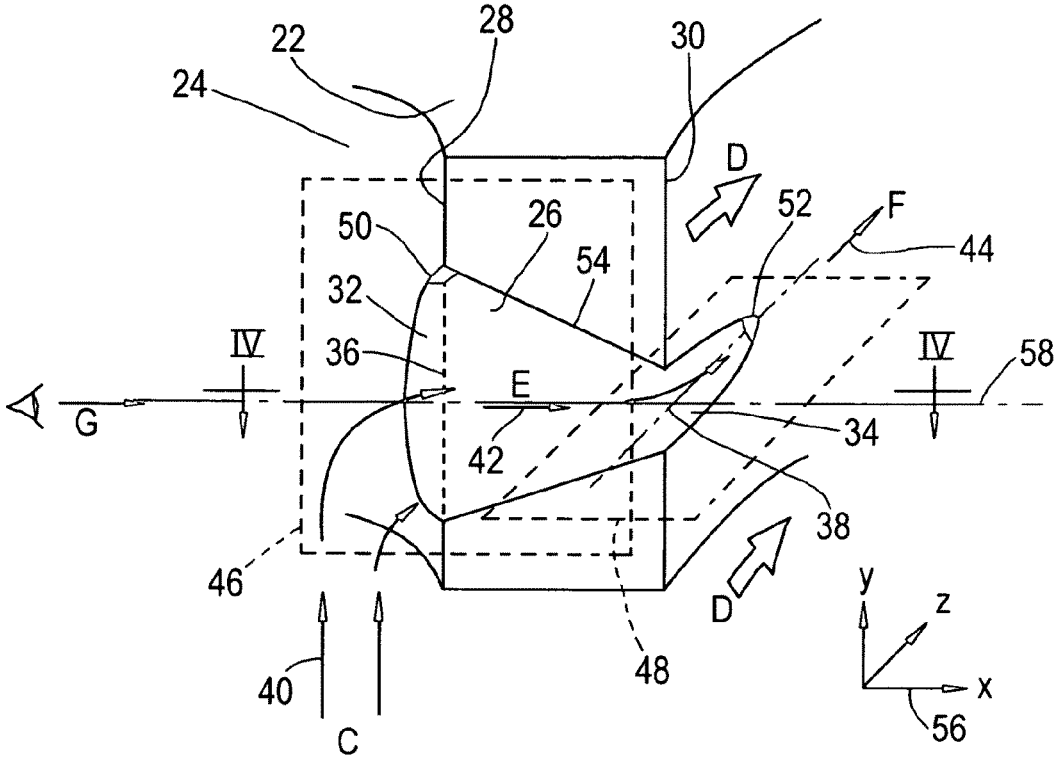
FIG. 3 is a side sectional view of part of a wall of the aerofoil, as indicated by section line III-III in FIG. 4.
Figure 4:
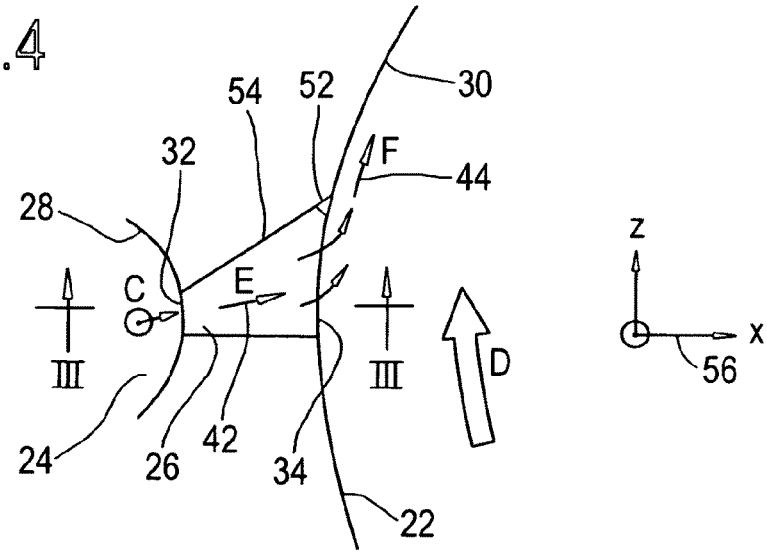
FIG. 4 is a sectional view from above of the part of the wall of FIG. 3 as indicated by section line IV-IV in FIG. 3.

Referring to FIGS. 3-5, the inlet area 32 has an elliptical or oval shape which is elongated along one axis 36. The elongate inlet area axis 36 extends generally along the length of the aerofoil 20.

The outlet area 34 has an elliptical or oval shape which is elongated along an elongate outlet area axis 38. The elongate outlet area axis 38 extends substantially laterally across the aerofoil 20.

For reference, FIGS. 3 and 4 each include a reference axis 56, which shows X, Y and Z axes. Referring to FIG. 3, a first plane 46 is defined, which by reference to the reference axis 56 is the XY plane, and a second plane 48 is defined, which, by reference to the reference axis 56 is the XZ plane. The inlet area axis 36 lies on first plane 46. The outlet area axis 38 lies on the second plane 48 which is orientated substantially at 90° to the first plane 46. The plane in which the outlet area axis 38 lies is thus orientated at substantially 90° to the plane in which the inlet area axis 36 lies.

When viewed from the side, as shown in FIG. 3, passage surfaces 54 defining the passage 26 appear to converge from the inlet area 32 to the outlet area 34. When viewed from above, as shown in FIG. 4, the passage surfaces 54 diverge from the inlet area 32 to the outlet area 34.

FIG. 5 shows a view along the passage axis 58 as seen by a viewer viewing along arrow G shown in FIG. 3. The outlet area axis 38 and the second plane 48 are at substantially 90° to the inlet area axis 36 and the first plane 46.

In use, cooling air flows in a first direction 40 along the interior 24 as shown by arrows C. The first direction 40 is generally along the length of the aerofoil and along the length of the longitudinal axis of the interior 24. A cooling air flow flows through the passage 26 in a second direction 42 as shown by arrow E. In a gas turbine engine, the first direction could be a radial direction relative to an engine shaft.

The elongate inlet area axis 36 is substantially parallel to the first direction 40. The first direction 40 and second direction 42 lie in the first plane 46, and thus are substantially coplanar with the inlet area axis 36.

As shown in FIG. 4, the symbol comprising a dot within a circle indicates an arrow coming out of the paper towards the viewer.

The passage cooling air flow exits the passage 26, where it meets with an external fluid flow in a third direction 44 as indicated by arrows D across the exterior surface 30 which could be a flow comprising combustion gases. In a gas turbine engine, the third direction could be a rotational direction around an engine shaft. The cooling air flow meets the external fluid flow and flows in the third direction 44 along the exterior surface of the walls 22 of the aerofoil 20. The third direction 44 generally extends along or is parallel with the orientation of the elongate outlet area axis 38, and lies in the second plane 48, and thus is coplanar with the elongate outlet area axis 38.

The advantages provided by the invention are as follows. The cooling air flowing in the first direction 40 as shown by arrow C along the interior 24 includes particles of dirt. The inlet area 32 of the passage 26 defined in the walls 22 forms a trap for the dirt particles, which can cause build up on those surfaces which are opposed to the motion of the cooling air. Thus, dirt build up will tend to occur along the uppermost (as shown in FIG. 3) or downstream part of the inlet area 32 as indicated by reference numeral 50.

Dirt build up also occurs at the inlet area 32 as a result of the change in direction of the cooling air entering the passage 26. Dirt particles entrained in the cooling air flow are carried by centrifugal force towards the uppermost or downstream part of the inlet area 32 and can result in dirt build up in this area.

By elongating the inlet area 32 along the inlet area axis 36 parallel with the first direction 40, the size of the uppermost or downstream area of the inlet area 32 is reduced, thus reducing the amount of build up, and when build up does occur, this has relatively less effect upon the available inlet area remaining, thus providing a passage 26 which is resistant to blockage at the inlet area 32.

Similarly, dirt particles can build up in the downstream part of the outlet area 34 as indicated by reference numerals 52. Such dirt build up can be caused by dirt particles entrained in the external flow indicated by arrows D, or by dirt particles entrained in the cooling passage flow indicated by arrow E. In either case, the dirt build up is reduced by elongating the outlet area axis 38 along the third direction 44, which reduces the area available for dirt build up, and also reduces the effects of any dirt build up which does occur, thus providing a cooling passage 26 which is resistant to blockage at the outlet area 34.

Aerofoils 20 of the invention can be formed by soluble core casting, and could be formed by using a laser. Such aerofoils could be formed of high temperature metal alloys, which could be nickel or titanium alloys.

Various other modifications could be made without departing from the scope of the invention. The inlet areas and outlet areas could be of any suitable size and elongate shape and could be orientated in any suitable way relative to each other. For example, the outlet area could be offset laterally relative to the inlet area, and/or could be offset vertically relative to the inlet area. Depending on the flow directions of the cooling air and external flows, the elongate axis of the inlet area and the outlet area could be orientated at different angles to each other. The aerofoil could be formed in any suitable way, of any suitable material.

There is thus provided an aerofoil which is resistant to blockage of film cooling passages. As a result of the reduced rate of build up of dirt and reduced rate of blockage, fewer, smaller cooling passages are required, resulting in reduced manufacturing costs, and improved engine and cooling efficiency.

The invention claimed is:

1. An aerofoil for a gas turbine engine, the aerofoil comprising:

at least one wall defining an interior along which in use cooling air flows in a first direction, the at least one wall defining a passage extending from an interior surface of the at least one wall to an exterior surface of the at least one wall to permit in use a cooling air flow in a second direction therealong, wherein the passage includes an inlet area defined by the interior surface, the inlet area having a shape which is elongated along one axis, the elongate axis of the inlet area extending along or being substantially parallel with the first cooling air flow direction, an external fluid flowing across the exterior surfaces of the at least one wall in a third direction, cooling air on exiting the passage, flowing in said third direction, the passage includes an outlet area, which is defined by the exterior surface, and which has a shape which is elongated along one axis so that the elongate axis of the outlet area extends along or substantially parallel to the third direction, the elongate axis of the inlet area and the outlet area are oriented at different angles to each other, the elongate axis of the inlet area lies on a first plane, and the first and second directions lie on the same plane, and the passage converges from the inlet area to the outlet area along the first plane.

2. An aerofoil according to claim 1, wherein the third direction is substantially at an angle to the first direction when viewed along the length of the passage.

3. An aerofoil according to claim 2, in which the angle is substantially 90°.

4. An aerofoil according to claim 1, wherein the elongate axis of the outlet area lies on a second plane, and the second and third directions lie on the same plane.

5. An aerofoil according to claim 4, wherein the elongate axis of the inlet area lies on the first plane and the second plane is orientated at an angle to the first plane.

6. An aerofoil according to claim 5, wherein the second plane is orientated at substantially 90° to the first plane.

7. An aerofoil according to claim 1, wherein the aerofoil has a length, the interior extends along the length, the passage extends laterally through the wall, the first direction is along the length and the second direction is at an angle to the first direction.

8. An aerofoil according to claim 1, wherein the second direction is substantially at 90° to the first direction.

9. An aerofoil according to claim 1, wherein the inlet area is elliptical or oval in shape.

10. An aerofoil according to claim 9, wherein the passages are regularly spaced, and arranged in rows, which extend along the length of the aerofoil.

11. An aerofoil according to claim 1, wherein the outlet area is elliptical or oval in shape.

12. An aerofoil according to claim 1, wherein the aerofoil defines a plurality of passages.

13. An aerofoil according to claim 1, wherein the aerofoil forms part of one of a turbine and a nozzle guide vane for a gas turbine engine.

14. A gas turbine engine, wherein that engine includes an aerofoil, the aerofoil being as claimed in claim 1.

* * * * *